US008261713B2

(12) United States Patent
Stoeckl et al.

(10) Patent No.: US 8,261,713 B2
(45) Date of Patent: Sep. 11, 2012

(54) CRANKING DEVICE OF AN INTERNAL COMBUSTION ENGINE

(75) Inventors: Rainer Stoeckl, Schwieberdingen (DE); Mathias Fein, Besigheim-Ottmarsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/734,382

(22) PCT Filed: Oct. 27, 2008

(86) PCT No.: PCT/EP2008/064514

§ 371 (c)(1), (2), (4) Date: Aug. 17, 2010

(87) PCT Pub. No.: WO2009/056516

PCT Pub. Date: May 7, 2009

(65) Prior Publication Data

US 2010/0307441 A1 Dec. 9, 2010

(30) Foreign Application Priority Data

Oct. 29, 2007 (DE) ..... 10 2007 051 595

(51) Int. Cl.
*F02M 11/00* (2006.01)

(52) U.S. Cl. ..... 123/179.25; 29/38 C

(58) Field of Classification Search ..... 290/38 R, 290/38 C, 39; 123/179.25, 179.15, 195 C; 74/7 R, 7 B, 7 C See application file for complete search history.

(56) References Cited

U.S. PATENT DOCUMENTS

| | | | | |
|---|---|---|---|---|
| 3,020,771 | A | 2/1962 | Redick | |
| 5,834,852 | A * | 11/1998 | Katoh et al. | 290/38 R |
| 5,844,336 | A * | 12/1998 | Ohya et al. | 310/80 |
| 5,943,909 | A * | 8/1999 | Soh | 74/6 |
| 6,454,824 | B1 | 9/2002 | Maryamchik et al. | |
| 6,720,668 | B2 * | 4/2004 | Niimi | 290/38 R |
| 6,753,621 | B2 * | 6/2004 | Hasegawa et al. | 290/38 R |

FOREIGN PATENT DOCUMENTS

| | | |
|---|---|---|
| CN | 1217424 | 5/1999 |
| CN | 1387937 | 1/2003 |
| DE | 31 31 149 | 2/1983 |
| DE | 297 04 299 | 7/1998 |
| DE | 10 2006 042 683 | 4/2007 |
| EP | 0 863 309 | 9/1998 |
| EP | 1 806 498 | 7/2007 |
| JP | 08 004635 | 1/1996 |

* cited by examiner

*Primary Examiner* — Stephen K Cronin
*Assistant Examiner* — Arnold Castro
(74) *Attorney, Agent, or Firm* — Kenyon & Kenyon LLP

(57) ABSTRACT

A cranking device of an internal combustion engine includes an electric machine having a drive unit, which electric machine is in mechanical operative connection with a commutator by way of an armature shaft. A protective element is disposed in the region of the drive unit, particularly the stator and/or armature, in such a way that a separating effect is provided with respect to an operating region of the commutator.

16 Claims, 5 Drawing Sheets

CRANKING DEVICE OF AN INTERNAL COMBUSTION ENGINE

BACKGROUND OF THE INVENTION

1. Field of the Invention

The present invention relates to a cranking device of an internal combustion engine.

2. Description of Related Art

A cranking device for internal combustion engines of the type mentioned in the introduction is known from the published German utility model document DE 297 04 299 U1. The cranking device for internal combustion engines described therein has a cranking motor, which is disposed in a pole casing and has a drive shaft that is in operative connection to a driven shaft via a reduction gear. The driven shaft is part of a starter-pinion drive having an overrunning clutch and a starting pinion. The starting pinion is disposed on the driven shaft in a manner that allows axial displacement and engagement with the ring gear of a starter gear of the internal combustion engine by axial displacement.

The drive shaft of the cranking motor carries an armature and a commutator having carbon brushes together with a current supply. Via its end on the commutator side, the drive shaft is supported in a commutator bearing; on its opposite side, it is accommodated in an axial bore of the driven shaft with the aid of a lug. The drive shaft drives the driven shaft via a planetary gear. For this purpose, the driven shaft has an external gearing which drives planetary gears, which in turn are in comb-type engagement with a fixed internal gear. The planetary gears are supported on pins pressed into a flange of the driven shaft at the extremity. The extreme flange is facing the cranking motor. The driven shaft is supported behind the flange in a bore of the bearing of an intermediate bearing, and its other end is supported in a bearing of a housing which seals the pole casing and is clamped to it with the aid of tension rods. However, in such a system particles from the region of the commutator travel to the region of the armature and downstream components.

BRIEF SUMMARY OF THE INVENTION

In contrast, the cranking device of an internal combustion engine according to the present invention has the advantage that the stator and/or the armature as well as downstream components, in particular gears, are protected against the introduction of particles with the aid of a protective element. Particles such as dust, coal dust as well as any other type of media may originate from a commutator of the electric machine, in particular a cranking motor, or also from the external environment of the cranking device. Since the aforementioned components and especially the gearing exhibit a sensitive response to the entry of particles for design-related reasons, the use of the protective element makes it possible to achieve a longer service life of the gear and adjacent mechanical components. The protective element is disposed in the region of the drive unit, particularly the stator and/or armature, in such a way that a separating effect is provided with regard to the mentioned components relative to an operating region of the commutator. Due to the positioning of the protective element and a resulting geometrical structure of the element, the technical approach in this case allows the use of a simple sealing means, i.e., a sealing means that is able to be produced and put in place at low expense, possibly in conjunction with a slight modification of existing components.

The result is an isolation of the mechanical components from harmful particles or also the trapping of such particles.

Both the isolation and also the trapping subsequently create a barrier for particles, so that the service life and the quality of lubricants present in gears are able to be increased. Furthermore, the material wear is reduced, especially the wear on bearings, bushings and gear components, since particles are kept away from these components. Last but not least, by adapting the geometry of the protective element, a more advantageous air flow may be created, which in turn leads to improved cooling of heat-sensitive components. If the cranking device is monitored for wear and/or function and/or the degree of contamination with the aid of an electronic monitoring system, then a corresponding report, possibly in the form of a servicing request, will be output only at a considerably longer service life of the internal combustion engine.

In one advantageous development of the present invention, the protective element is implemented as guard ring, particularly one having an I-shaped, L-shaped, or U-shaped profile. Depending on the desired method of functioning and the design, the most suitable protective element may be used. For example, a simple separating element is able to be realized by the I-shaped design, while the L-shaped protective element may be effective as trapping element. The U-shaped design of the protective element also functions as receiving vessel for harmful particles.

In a further advantageous development of the present invention, the protective element is disposed at the level of an armature bandage on a housing. For that purpose the protective element is radially adapted in such a way that an air gap remaining with respect to the peripheral area of the armature bandage is kept as small as possible, an existing air flow is modified in the sense of an improved cooling effect, and the entry of particles and media into the mechanical region is reduced.

In one example development of the present invention, the protective element is disposed at the level of an extremity of the armature on a permanent solenoid and/or on the housing. The protective element is adapted and placed in such a way that the air gap between an inner peripheral surface area of the protective element and the armature is as small as possible, or that free spaces between segments of the permanent solenoid are closed off.

In another example development of the present invention, the protective element is disposed on the armature bandage, especially on its circumference. The protective element is radially adapted in such a way that an air gap remaining with respect to the peripheral area of a pole casing is kept as small as possible, an existing air flow is modified in the sense of an improved cooling effect, and the entry of particles and media into the mechanical region is reduced.

According to an advantageous development of the present invention, the protective element is disposed in interspaces of the permanent solenoid, the interspaces being sealed and the air gap between the circumferential area of the armature and the solenoid package being reduced.

According to a further advantageous development of the present invention, the protective element is situated in the region of an end face of the armature bandage and on the housing. The protective element is positioned in such a way that the air gap between the armature bandage and the protective element is reduced in the axial direction, and that the air gap between the armature bandage and the commutator is reduced in the radial direction. An already existing current bar, especially for six carbon brush holders, may be used as protective element for this purpose.

In one exemplary embodiment of the present invention, the protective element is provided with a supplementary contour and is disposed on the permanent solenoid and/or on the housing, in particular at the level of the extremity of the armature. A labyrinth or also a vessel is provided in the process. Using these constructive measures, media flowing about are able to be collected and possibly removed in the course of servicing.

In one further exemplary embodiment of the present invention, the protective element having the supplementary contour is disposed in the region of a housing opening. In this embodiment, the protective element in conjunction with part of the housing, particularly the pole casing, forms a labyrinth whose end terminates in an outlet of the housing in order to carry off the collected particles.

Equipping a start-stop system with the cranking device according to the present invention is also advantageous because such a system makes higher demands on the stability and service life of the associated gear due to more frequent startup operations. The system automatically switches the internal combustion engine off whenever the vehicle is stopped and restarts the internal combustion engine without a delay as soon as the vehicle driver engages a gear, for instance, and/or whenever the brake pedal is released.

Furthermore, it is advantageous to provide an internal combustion engine with the cranking device according to the present invention and/or with the aforementioned start-stop system because this makes it possible, for one, to have an even more reliable component start the internal combustion engine and, for another, to obtain considerable savings in fuel when driving inside city limits.

DETAILED DESCRIPTION OF THE INVENTION

Figure 1:
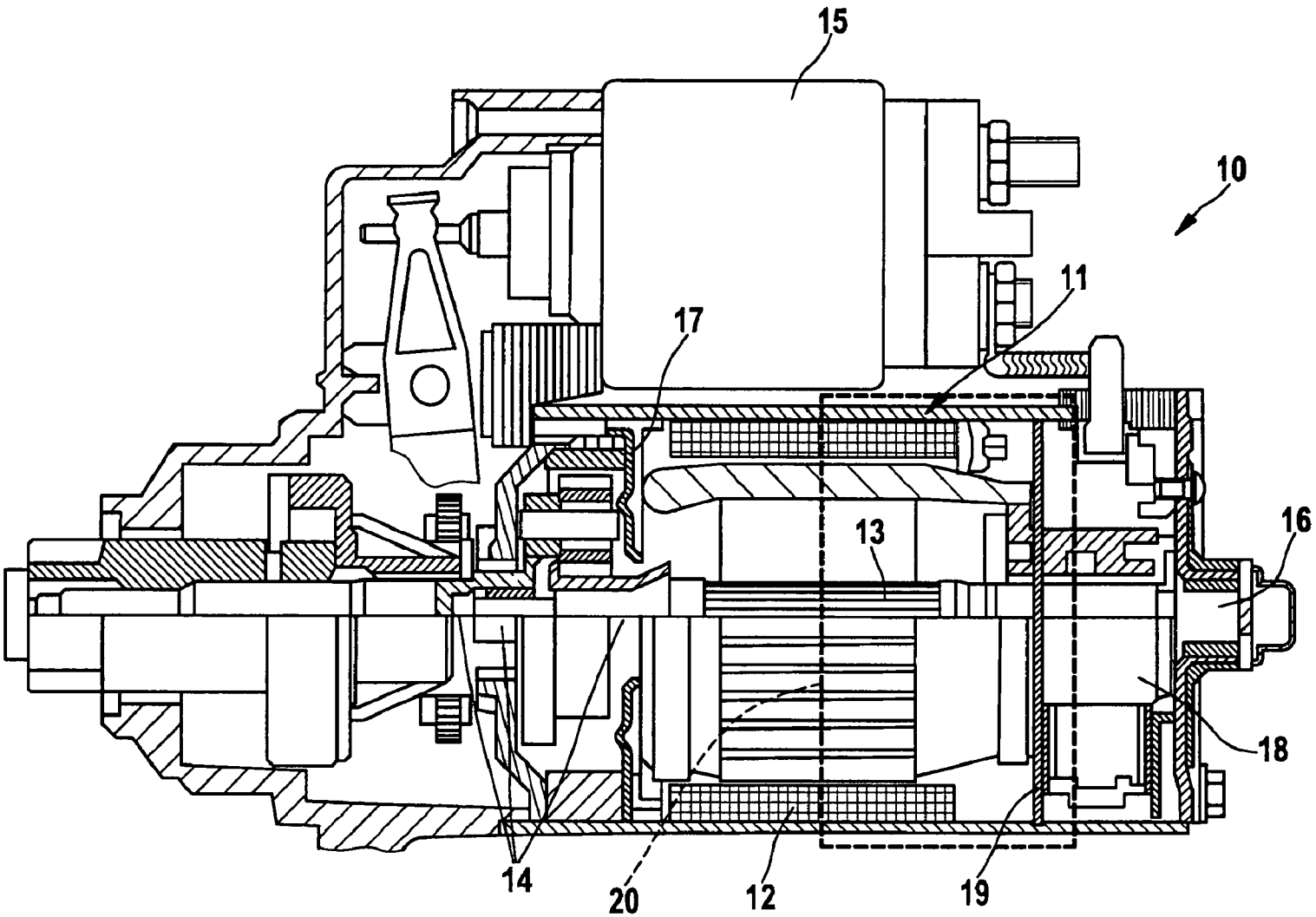
FIG. 1 shows a sectional view of a cranking device having a planetary gear and an electric cranking machine and also having an engagement relay.

FIG. 1 shows a cranking device 10 of an internal combustion engine. Cranking devices of this type are used predominantly in motor vehicles and referred to as starters, in particular pre-engaged drive starters. Among the main components are an electric machine 11, also denoted as cranking machine, having a drive unit which includes a stator 12 and an armature 13 or rotor, a gear 14, in particular a planetary gear, and an engagement relay 15, in particular a solenoid switch. Electric machine 11 is in mechanical operative connection with gear 14 by way of an armature shaft 16. Gear 14 is separated from electrical machine 11 by a separation element 17, in particular a cover plate or also cover disk, the separation element adjoining armature shaft 16. A commutator 18 is situated on armature shaft 16 on a side lying across from the gear side. It is essential in this context that a protective element 19 is disposed in a placement and operating region of the drive unit, in particular stator 12 and/or armature 13, in such a way that a separating effect is provided with regard to a placement and operating region of commutator 18. Protective element 19 is situated in a region that is framed by a marking window 20 according to FIG. 1. The present technical approach thus produces a system in which gear 14 and additional components are protected against the entry of particles or also media.

During the startup operation of the internal combustion engine, the solenoid switch briefly connects electric machine 11 to the internal combustion engine via a gear wheel drive. Due to the typically high rotational speed of electric motor 11 and a torque required for the startup operation, a high translation ratio of approximately 13:1, in particular, is required. The desired translation ratio is achieved by a pinion, especially a starter pinion, on the starter, and by a pinion of an associated flywheel that is relatively large in comparison with the starter pinion. The starter pinion is axially displaceable on armature shaft 16 in an infinitely variable manner, and is brought into engagement with the gearing of the flywheel by the solenoid switch or also the electromagnet. Then, electric motor 11 is switched on by closing a contact switch, which is part of the solenoid switch, or engagement solenoid. The starter pinion is equipped with an overrunning clutch, which prevents the started internal combustion engine from driving electric machine 11 at an excessively high rotational speed via the still engaged starter pinion and thereby damages or destroys the electric machine. Such starters generally have a series-wound motor or a permanent-magnet-energized motor as electric machine.

In the case at hand, electric machine 11 is an internal rotor whose armature 13 defines the inner part, and whose stator 12 defines the outer part of electric machine 11. A coil, in particular an armature coil, of armature 13 is controlled via commutator 18. Via two fixed carbon brushes, which are pressed against a drum rotating together with armature 13, commutator 18 provides an indirect line connection to the windings of armature 13. The surface of the drum is subdivided into segments that are insulated with respect to each other. As is common in a DC electric machine, armature 13 has half as many windings as there are segments on commutator 18. Each winding is connected at its ends to two segments lying opposite one another. Because of the special demands on the torque and the current flow, the cross-section between the segments and the associated carbon brushes is particularly broad. In the case of four carbon brushes, two windings must be effective at the same time.

Figure 2:
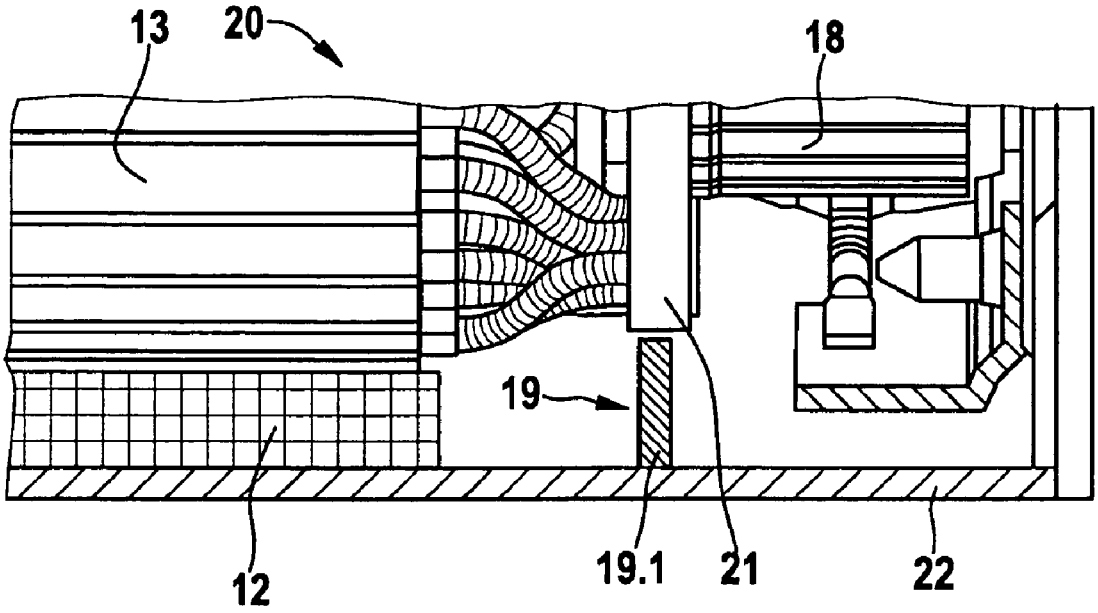
FIG. 2 shows a detail view of an exemplary embodiment of the cranking device according to the present invention, having an annular protective element affixed on a housing.

According to FIG. 2, a first development of a seal or encapsulation within marking window 20 is illustrated in an enlarged detail view, the seal or encapsulation being formed by annular protective element 19 and a dish-shaped armature bandage 21. Protective element 19 is disposed on a housing 22, in particular a pole casing, as add-on component. The placement is implemented by fixing protective element 19 in place at the axial height of armature bandage 21. The affixation of protective element 19 on housing 22 may be implemented by a joining process, in particular a press-on operation, by shrinking, deep-drawing, welding, ultrasonic welding, adhesive bonding or the like. Protective element 19 has a base segment 19.1, which has a perforation for armature bandage 21, so that a development is provided between the outer annular lateral area of armature bandage 21 and the inner annular lateral area of protective element 19 that separates the placement and operating regions of the drive unit, in particular stator 12 and armature 13, and of commutator 18.

Figure 3:
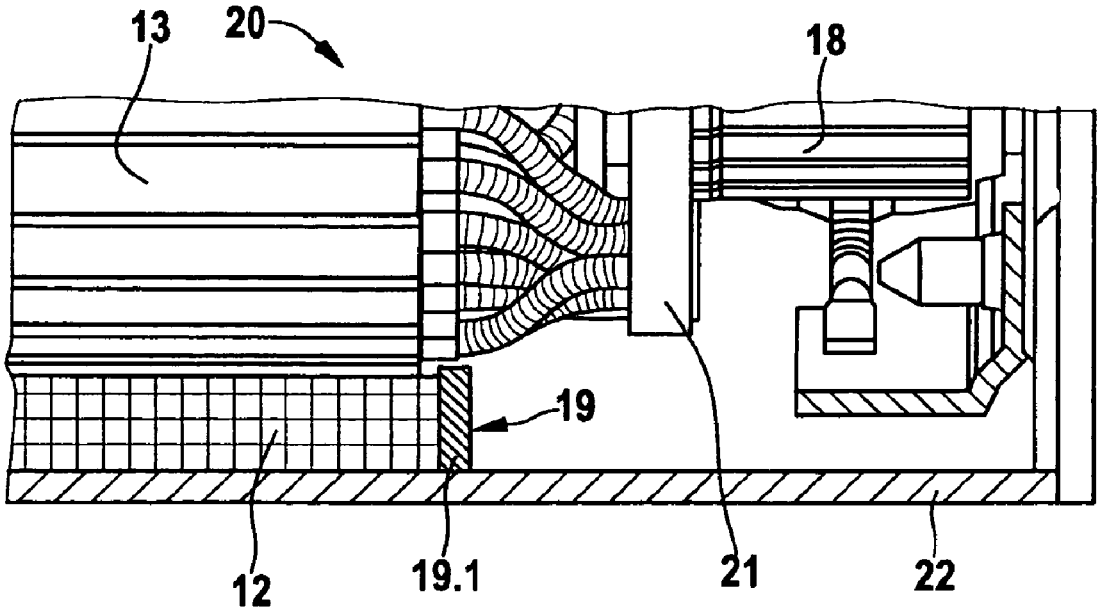
FIG. 3 shows a detail view of an additional exemplary embodiment of the cranking device according to the present invention, having an annular protective element affixed on a solenoid package.

According to FIG. 3, another exemplary embodiment of the seal or encapsulation within marking window 20 is shown in an enlarged detail view. In this instance, protective element 19 is situated directly on a permanent solenoid of stator 12 and on housing 22. The affixation of protective element 19 on the solenoid or on housing 22 may be implemented with the aid of the joining processes listed according to FIG. 2. Protective element 19 likewise has base segment 19.1, which is provided with the perforation for armature 13 as such, so that the separation of the two regions of the drive unit and of commutator 18 takes place between the outer annular lateral area of armature 13 and the inner annular lateral area of protective element 19.

Figure 4:
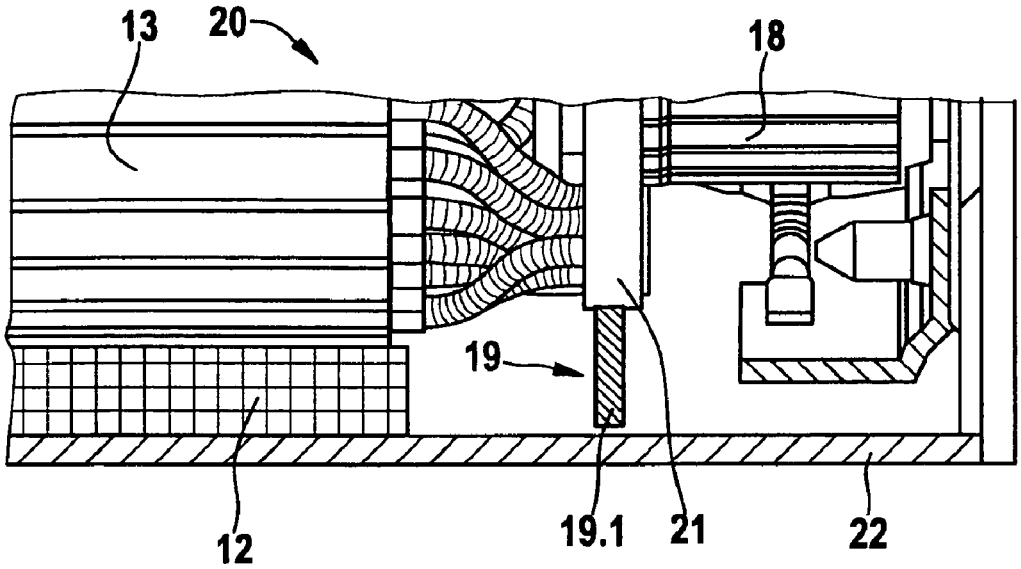
FIG. 4 shows a detail view of an exemplary embodiment of the cranking device according to the present invention, having an annular protective element affixed on an armature bandage.

In FIG. 4 as well, an embodiment of the seal or encapsulation within marking window 20 is shown in an enlarged detail view. Protective element 19 is situated directly on armature bandage 21 as add-on component. The placement is implemented by fixing protective element 19 in place at the axial height of armature bandage 21. The affixation of protective element 19 on armature bandage 21 may be implemented by a joining process, in particular a press-on operation, by shrinking, deep-drawing, welding, ultrasonic welding, adhesive bonding or the like. Here, too, base segment 19.1 according to FIG. 4 is provided with the perforation for armature bandage 21, so that the regional separation is provided between the outer annular lateral area of protective element 19 and the inner annular lateral area of housing 22, while the residual gap remains.

Figure 5:
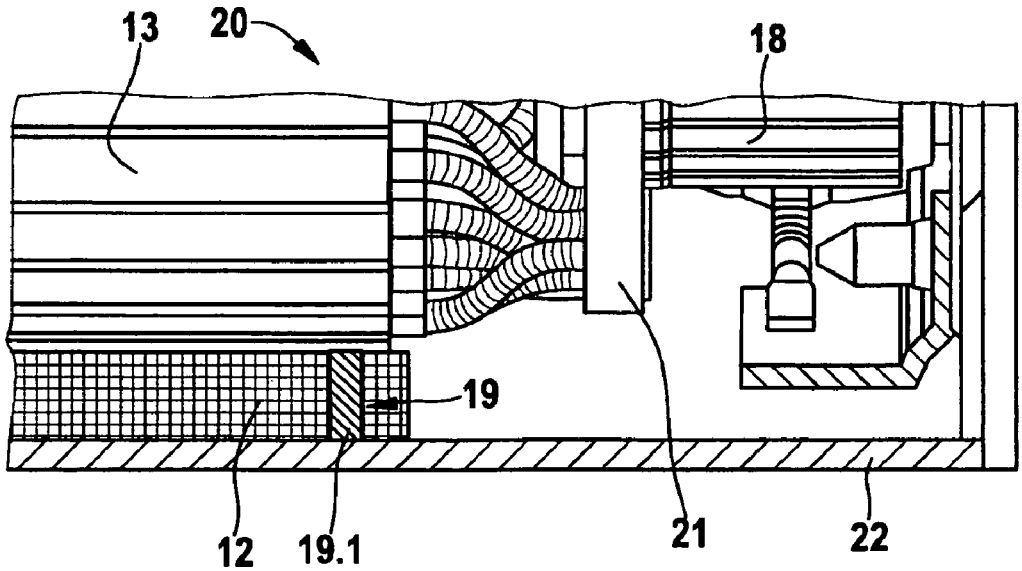
FIG. 5 shows a detail view of an additional exemplary embodiment of the cranking device according to the present invention, having an annular protective element which is disposed in interspaces of the solenoid package.

FIG. 5 shows an enlarged detail view of another exemplary embodiment of the seal or encapsulation within marking window 20. According to the present development variant, protective element 19 is situated in interspaces of the permanent solenoid of stator 12 and on housing 22. The affixation of protective element 19 on the solenoid or on housing 22 may be implemented with the aid of the joining processes listed according to FIG. 2. Protective element 19 likewise includes base segment 19.1, which is provided with the perforation for armature 13 and additionally with recesses for solenoid segments, so that the regional separation becomes effective between the outer annular lateral area of armature 13 and the inner annular lateral area of protective element 19.

Figure 6:
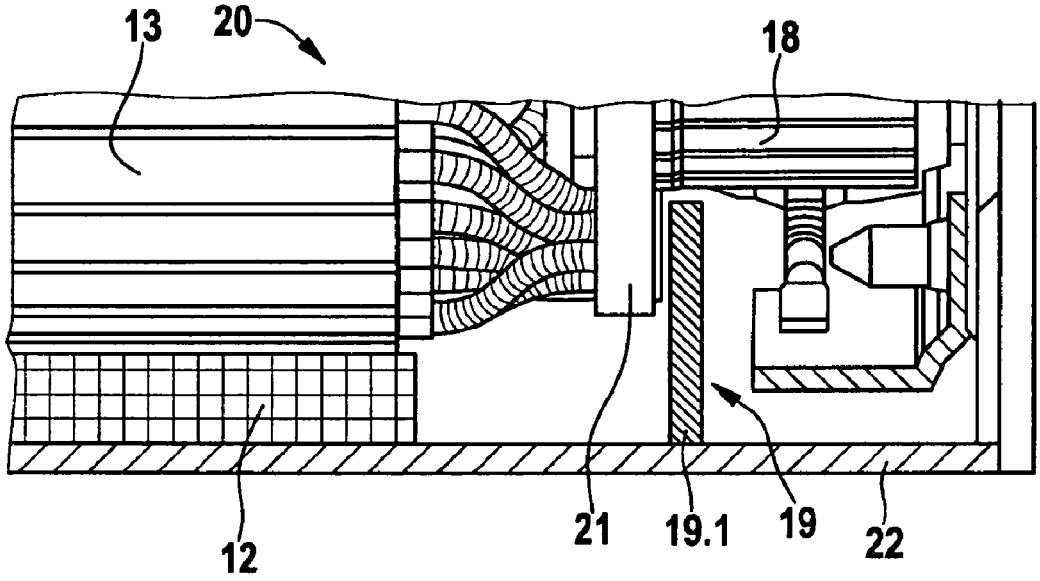
FIG. 6 shows a detail view of an exemplary embodiment of the cranking device according to the present invention, having an annular protective element which is affixed on the housing and covers an end face of the armature bandage.

FIG. 6 shows an enlarged detail view of an exemplary embodiment of the seal or encapsulation within marking window 20. Via its outer lateral area, protective element 19 is affixed on housing 22 and situated at an end face of armature bandage 21. The affixation of protective element 19 on housing 22 may be implemented with the aid of the joining processes listed according to FIG. 2. An existing current bar may be used as protective element 19 within the sense of a dual function. In this case as well, base segment 19.1 of protective element 19 is provided with the perforation, which is provided for commutator 18, however, so that the regional separation including the remaining residual gap is provided between the outer annular lateral area of commutator 18 and the inner annular lateral area of protective element 19. A further residual gap exists between the surface of protective element 19 facing armature 13, and armature bandage 21. Overall, it is therefore possible to achieve a labyrinth-type encapsulation of the mechanical components relative to commutator 18. In the developments according to FIGS. 2 through 6, the air flow is cut off due to the sealing or encapsulation effect of protective element 19.

Figure 7:
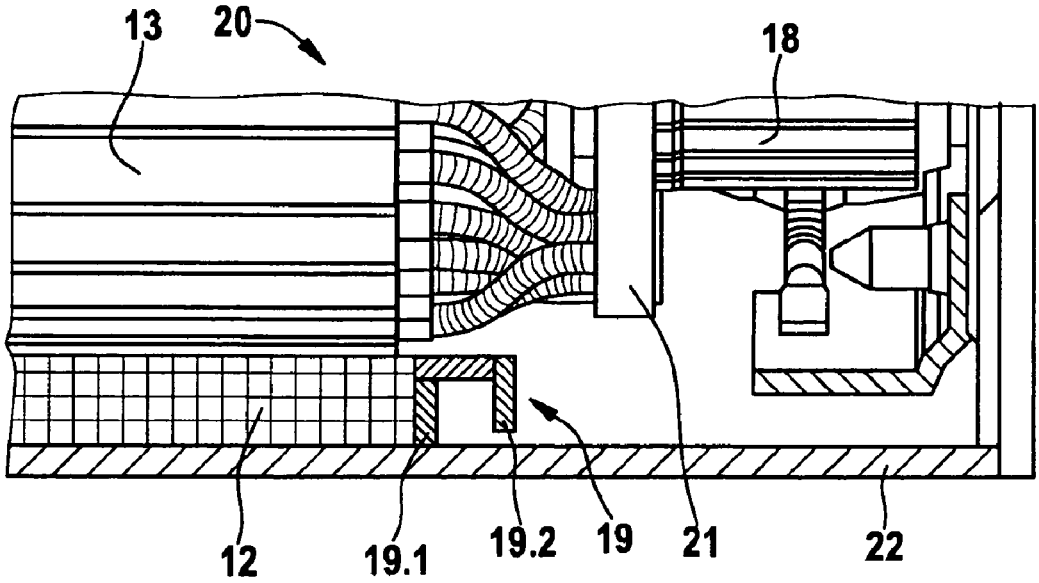
FIG. 7 shows a detail view of a further exemplary embodiment of the cranking device according to the present invention, having an annular protective element which is disposed on the solenoid package and forms a vessel.

FIG. 7 shows an enlarged detail view of another exemplary embodiment of the seal or encapsulation within marking window 20. Protective element 19 is situated directly on the permanent solenoid of stator 12 and on housing 22. The affixation of protective element 19 on the solenoid or on housing 22 may be implemented with the aid of the joining processes listed according to FIG. 2. In addition to base segment 19.1, protective element 19 includes an angular segment 19.2, the perforation for armature 13 being provided next to angular segment 19.2, so that the seal is created between the outer annular lateral area of armature 13 and the inner annular lateral area of protective element 19. Furthermore, angular segment 19.2 forms a vessel by its annular geometry, by which particles are able to be caught in the way of a trap. A combination with a further protective element 19 is possible, in particular in order to influence the air flow in a way that makes it possible to collect the media and particles in an efficient manner.

Figure 8:
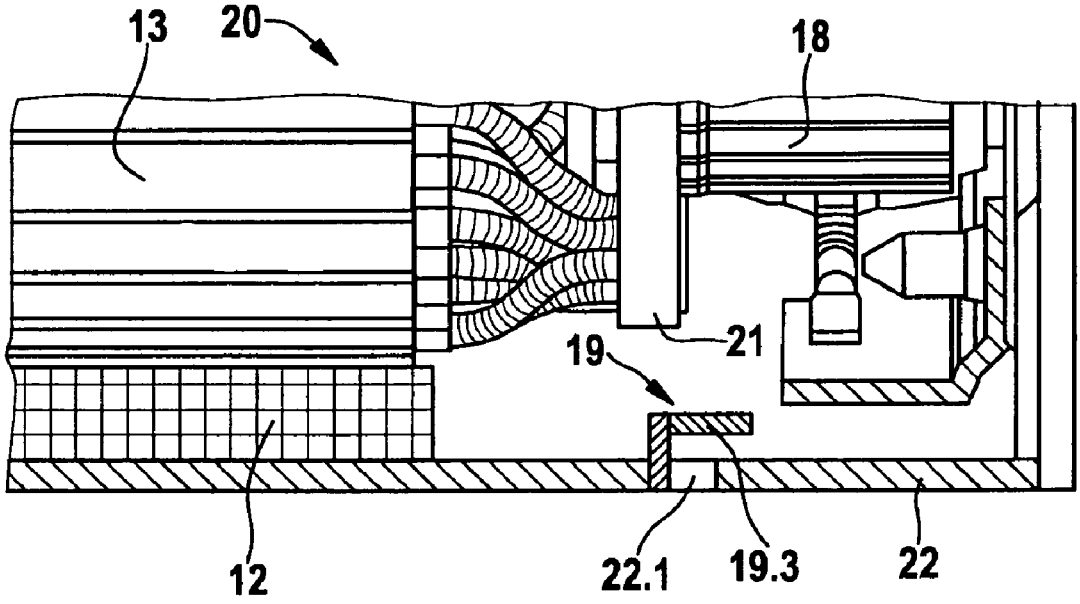
FIG. 8 a detail view of an exemplary embodiment of the cranking device according to the present invention, having an annular protective element which is affixed on the housing and acts as a type of trapping device.

FIG. 8 shows an enlarged detail view of an exemplary embodiment of the seal or encapsulation within marking window 20. Protective element 19 is disposed on the wall of housing 22. The affixation of protective element 19 on the wall of housing 22 may be implementing according to the previously enumerated joining processes. In addition to base element 19.1, protective element 19 has a supplementary segment 19.3, which is placed at the level of at least one wall opening 22.1 of housing 22, so that a labyrinth-type particle trap is provided between supplementary segment 19.3 and the housing wall.

In summary, the presence of an additionally placed component, in particular protective element 19 or a protective ring, in the border region between stator 12 or armature 13 and commutator 18 prevents the entry of particles and/or media of all types into gear 14, in particular planetary gears, and into downstream mechanical components, which increases the service life of said components. The focus is placed on reducing the size or abolishing existing air gaps and transitions between the placement and operating region of commutator 18 and the placement and operating region of stator 12, armature 13, the permanent solenoid, gear 14 and the like.

The affixation of protective element 19 on the various components of cranking device 10 may be implemented by a snap closure, bonding connection, by superficial fusing, pressing, by clamping, a welding joint, surface vulcanization, or with the aid of an injection molding process and the like. In addition, the entry of particles may be reduced by an adapted length of protective element 19 with respect to armature 13 or commutator 18. In general, protective element 19 may have a straight or curved design or a combined geometry. In addition, protective element 19 may have a geometry that is similar to a fan wheel, having a wavy or slotted form, or also any combination of the aforementioned variants, in order to influence the air flow and/or the component cooling.

Furthermore, an additional sealing lip may be disposed on protective element 19 or on armature 13, on armature bandage 21, or on commutator 18. Both the components that are assigned in pairs, such as protective element 19 together with armature 13 or armature bandage 21 or commutator 18, and the components in connection with the sealing lip may be designed to slide against each other. Both a single component material, in particular steel or plastic, and also a multi-component material may be used as materials. A combination of the previously described variants of embodiments with each other is possible as well, in particular in order to influence the air flow in a manner that allows the media and particles to be trapped and/or carried away. With the aid of the aforementioned constructive measures, the increased demands on stability and service life in gears used in cranking devices are satisfied, which has a positive effect, particularly in a start-stop system.

What is claimed is:

1. A cranking device for an internal combustion engine, comprising:

a commutator;

an armature shaft;

an electric machine having a drive unit including a stator and an armature, wherein the electric machine is in mechanical operative connection with the commutator via the armature shaft; and a protective element distinct from a brush-accommodating chambers disposed in the region of the drive unit such that the protective element substantially separates an operating region of the commutator from the remaining region of the cranking device;

wherein the protective element influences air flow or particle flow.

2. The cranking device as recited in claim 1, wherein the protective element is configured as a guard ring having at least one of an I-shaped profile, an L-shaped profile, or a U-shaped profile.

3. The cranking device as recited in claim 2, further comprising:

a housing; and an armature bandage;

wherein the protective element is disposed on an internal surface of the housing, substantially adjacent to the armature bandage.

4. The cranking device as recited in claim 2, further comprising:

a housing;

wherein the protective element is disposed on at least one of a permanent solenoid of the stator and on an internal surface of the housing, substantially adjacent to an extremity of the armature.

5. The cranking device as recited in claim 2, further comprising:

an armature bandage;

wherein the protective element is disposed on the circumference of the armature bandage.

6. The cranking device as recited in claim 2, wherein the protective element is disposed in an internal space defined within a permanent solenoid of the stator.

7. The cranking device as recited in claim 2, further comprising:

a housing; and an armature bandage;

wherein the protective element is disposed in the region of an end face of the armature bandage and on an internal surface of the housing.

8. The cranking device as recited in claim 4, wherein the protective element is provided with an angular segment.

9. The cranking device as recited in claim 8, wherein the protective element provided with the angular segment is disposed in the region of an opening of the housing.

10. The cranking device as recited in claim 1, wherein the protective element is configured as a guard ring having at least one of an I-shaped profile, an L-shaped profile, a U-shaped profile, or a circular geometry having a wavy or a slotted form.

11. A cranking device of an internal combustion engine, comprising:

an electric machine, which includes a drive unit and which is in mechanical operative connection with a commutator via an armature shaft; and a protective element distinct from a brush-accommodating chambers disposed in the region of the drive unit so that a separating effect is provided with regard to an operating region of the commutator, wherein the protective element is disposed one of: at the axial level of an armature bandage either on a housing or on the armature bandage, at the axial level of an extremity of the armature of the drive unit on a permanent magnet, in interspaces of the permanent magnet, and in the region of an end face of the armature bandage on the housing;

wherein the protective element influences air flow or particle flow.

12. The cranking device as recited in claim 11, wherein the protective element is implemented as a guard ring.

13. The cranking device as recited in claim 12, wherein the protective ring has one of an I-shaped profile, an L-shaped profile, and a U-shaped profile.

14. The cranking device as recited in claim 11, wherein the protective element is disposed on the radial circumference of the armature bandage.

15. The cranking device as recited in claim 13, wherein the protective element is provided with a supplementary contour configured as an angular segment.

16. A start-stop system, comprising:

a cranking device of an internal combustion engine, including:

an electric machine, which includes a drive unit and which is in mechanical operative connection with a commutator via an armature shaft; and a protective element distinct from a brush-accommodating chambers disposed in the region of the drive unit so that a separating effect is provided with regard to an operating region of the commutator, wherein the protective element is disposed one of: at the axial level of an armature bandage either on a housing or on the armature bandage, at the axial level of an extremity of the armature of the drive unit on a permanent magnet, in interspaces of the permanent magnet, and in the region of an end face of the armature bandage on the housing;

wherein the protective element influences air flow or particle flow.

* * * * *